US006378921B1

(12) United States Patent
Deischl et al.

(10) Patent No.: US 6,378,921 B1
(45) Date of Patent: Apr. 30, 2002

(54) HANDLE GRIP ASSEMBLY FOR A VEHICLE DOOR AND METHOD OF MAKING SAME

(75) Inventors: Hans Deischl, Jettingen; Juergen Jooss; Rudi Koelle, both of Sindelfingen; Martin Lindmayer, Sulz, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/411,640

(22) Filed: Oct. 4, 1999

(30) Foreign Application Priority Data

Oct. 2, 1998 (DE) ..... 198 45 395

(51) Int. Cl.[7] ..... E05B 3/00
(52) U.S. Cl. ..... 292/336.3; 292/DIG. 65
(58) Field of Search ..... 292/347, 336.3, 292/216, DIG. 65; 16/408

(56) References Cited

U.S. PATENT DOCUMENTS 4,482,179 A * 11/1984 Johnson ..... 292/336.3
4,588,219 A * 5/1986 Kobayashi ..... 292/336.3
4,591,196 A * 5/1986 Kurita ..... 292/336.3
4,883,296 A * 11/1989 Laurie ..... 292/336.3
5,685,581 A * 11/1997 Kritzler ..... 292/336.3

FOREIGN PATENT DOCUMENTS

| | | |
|---|---|---|
| DE | 30 30 519 | 2/1982 |
| DE | 36 06 347 | 2/1986 |
| DE | 3628376 A1 | 2/1988 |
| DE | 4126714 C1 | 9/1992 |
| DE | 4405383 A1 | 4/1995 |
| DE | 19522624 A1 | 1/1997 |
| EP | 0 646 688 | 4/1995 |
| EP | 0 795 667 | 9/1997 |

* cited by examiner

*Primary Examiner*—Gary Estremsky
(74) *Attorney, Agent, or Firm*—Crowell & Moring LLP

(57) ABSTRACT

A grip arrangement for a vehicle door is known which has a gripping bow which is arranged on a body shell of the vehicle door and can be moved by pulling and which is supported by means of at least one bearing surface in its inoperative position on a corresponding supporting section of the body shell. The gripping bow is provided in an area of the at least one bearing surface in sections with a clearing which, in the inoperative position, defines a distance of the bearing surface to the supporting section.

11 Claims, 1 Drawing Sheet

HANDLE GRIP ASSEMBLY FOR A VEHICLE DOOR AND METHOD OF MAKING SAME

BACKGROUND AND SUMMARY OF THE INVENTION

This application claims the priority of German application 198 45 495.7, filed Oct. 2, 1998, the disclosure of which is expressly incorporated by reference herein.

The invention relates to a grip arrangement for a vehicle door, having a gripping bow which is arranged on a shell of the vehicle door and can be moved by pulling, which gripping bow is in an operative connection with a lock triggering element of a door lock, the gripping bow being supported by means of at least one bearing surface in its inoperative position on a corresponding supporting section of the shell.

Such a grip arrangement is generally known for side doors of passenger cars. The grip arrangement has a gripping bow which is swivellably disposed on one end on a corresponding bearing arrangement in the area of the shell of the vehicle door and acts by means of its other end upon a lock triggering lever for activating the door lock. When the gripping bow is pulled toward the outside away from the shell, the gripping bow swivels about its bearing point and activates the lock triggering lever, whereby the vehicle door can be opened. In its inoperative position, the gripping bow is supported by means of a bearing surface on a corresponding supporting section of the shell, particularly in the area of its end activating the lock triggering lever. In the event of a vehicle impact and a corresponding deformation of the side doors, deformations of the shell may occur which may result in a lifting-off of the door grip which may cause an unintentional triggering of the door lock.

It is an object of the invention to provide a grip arrangement of the initially mentioned type which reduces the risk of triggering the door lock in the event of a deformation of the vehicle door.

This object is achieved in that the gripping bow is provided in the area of the at least one bearing surface in sections with a clearing which, in the inoperative position, defines a distance of the bearing surface from the supporting section. As the result of the solution according to the invention, the actual bearing surface of the gripping bow on the supporting section of the shell is reduced. This also reduces the risk that, in the event of a corresponding deformation of the vehicle door and therefore of the shell, the gripping bow is pressed away to the outside. The invention is based on the recognition that the attack of the deformed shell on the at least one bearing surface of the gripping bow was decisive for the cases of the unintentional triggering of the door lock. By reducing the area which, in the inoperative position, actually rests on the supporting section, the shell can carry out certain deformations without any moving-along of the gripping bow, in contrast to a gripping bow of a correspondingly wide bearing surface. The distance of a partial section of the bearing surface of the gripping bow from the supporting section formed by the clearing along a portion of the original bearing surface permits the deformation of the shell in every case until this distance has been overcome, without any movement of the gripping bow taking place. The characteristic that the bearing surface is provided with a clearing only in sections is based on the fact that a support of the gripping bow on the shell must continue to be ensured. However, it would be conceivable to provide the gripping bow in the area of its end connected with the lock triggering element completely with a clearing so that there will no longer be a bearing surface at this end. Instead, a bearing surface in the area of the swivel bearing at the other end or at another point of the gripping bow would then have to be enlarged correspondingly in order to achieve a secure supporting of the gripping bow in the inoperative position. However, the solution which is more advantageous with respect to the operability is the solution of leaving, in each supporting area, a residual bearing surface in any case despite the providing of a clearing. A side door and/or a rear door of a motor vehicle, particularly of a passenger car, can be provided as the vehicle door.

As a development of the invention, the clearing is surrounded in the inoperative position by a flexible covering lip. As the result of the covering lip, the distance between the bearing surface of the gripping bow and the supporting section of the shell, which is formed by the clearing, is covered in the inoperative position, resulting, on the one hand, in a visually attractive appearance and, on the other hand, at least largely preventing the penetration of water and dirt into the interior of the vehicle door at the level at which the gripping bow passes through the shell.

As a further development of the invention, the clearing is provided on a lower half—relative to the installed operating position—of the gripping bow. This further development takes into account the recognition that, in the event of a vehicle impact of a passenger car, particularly the area of the shell of the vehicle door situated below the grip arrangement is considerably deformed, so that a remaining bearing surface above the center of the gripping bow presents no great risk of causing a triggering of the door lock by a deformation of the shell.

Additional advantages and characteristics of the invention are found in the subclaims as well as in the following description of a preferred embodiment of the invention which is illustrated by means of drawings.

Other objects, advantages and novel features of the present invention will become apparent from the following detailed description of the invention when considered in conjunction with the accompanying drawings.

DETAILED DESCRIPTION OF THE DRAWINGS

In a manner known in principle, a side door of a passenger car has an exterior shell serving as the vehicle body shell 1 as well as an interior shell, which are fixedly connected with one another. Normally, the side door is swivellably arranged on a self-supporting body structure of the body of a passenger car by means of a hinge arrangement which is situated on a forward front area—relative to the normal driving direction—of the side door. The opposite rear-side edge of the side door is equipped with a door lock which, in a manner known per se, interacts with a lock bolt or lock bow fixed on the body side in the door opening.

Figure 1:
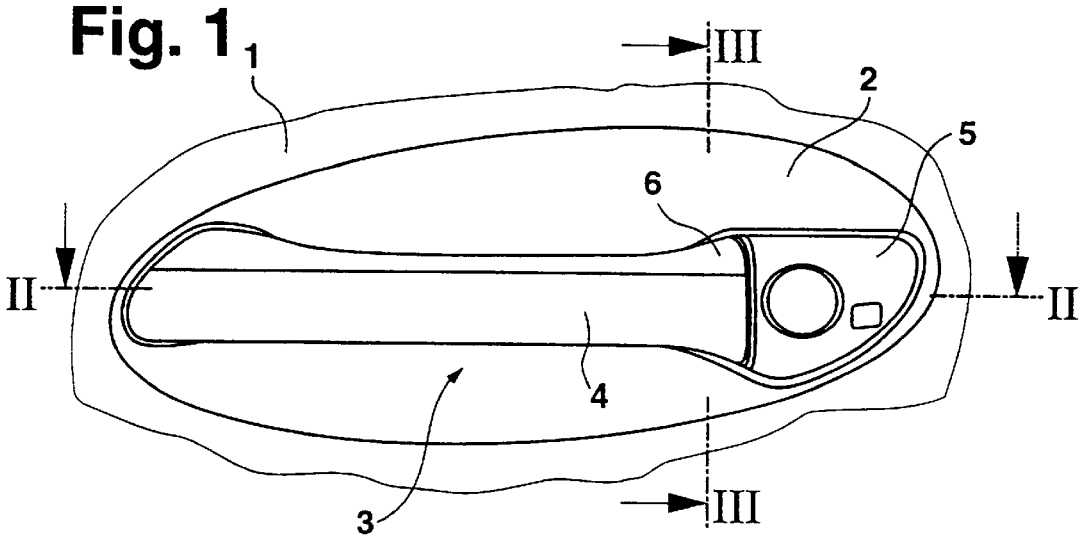
FIG. 1 a frontal view of an embodiment of a grip arrangement according to the invention on a body shell of a vehicle door.
Figure 2:
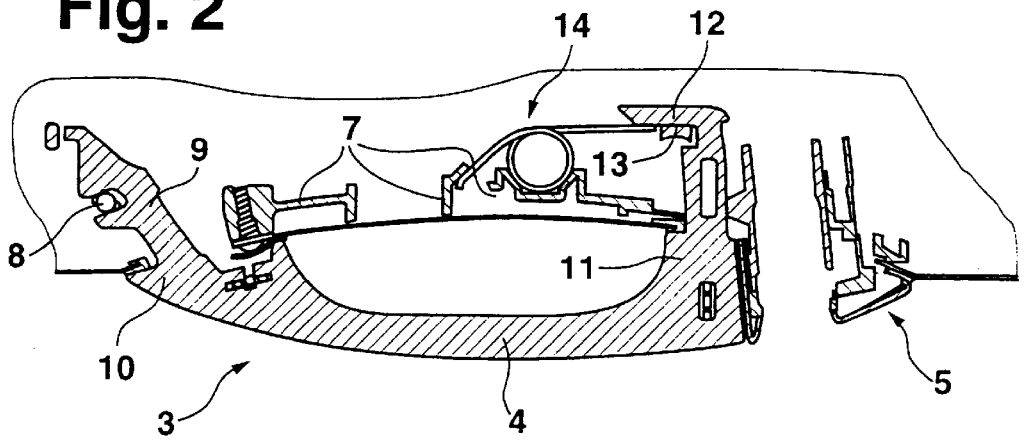
FIG. 2 is a longitudinal sectional view of the grip arrangement according to FIG. 1 along the section Line II—II in FIG. 1.

When the side door is closed, the door lock can be unlocked by means of a grip arrangement 3 on the side door which is fixed on the body shell 1 in the area of an inwardly curved grip depression 2. The grip arrangement 3 has a gripping bow 4 which is arranged to be swivellable within certain limits and which, for opening the side door, is positioned such that it can be pulled to the outside away from the body shell 1 out of its inoperative position illustrated in FIGS. 1 to 3. In addition, the grip arrangement 3 has a housing section 5 which is used for accommodating a lock cylinder which is not shown. The gripping bow 4 situated on the outside is held on a bearing bow 7 which is fixed on an interior side of the depression 2 of the body shell 1 (FIG. 2). The bearing bow 7 has a bearing pin 8 on which the gripping bow 4 is swivellably disposed. For this purpose, the gripping bow 4 has on its forward end area 10 a bearing projection 9 which penetrates the body shell 1 and extends around the bearing pin 8.

In addition, the gripping bow 4 is equipped on its—viewed in the driving direction—rearward end area with an activating web 12 which also projects into the interior of the side door and extends behind a lock activating lever 13 of the door lock. In addition, the activating web 12 is acted upon by a restoring spring 14 which is held on the bearing bow and which is designed as a leg spring, such that the gripping bow 4 is pressed in its inoperative position against the body shell 1.

For this purpose, the gripping bow 4 is provided on its rearward end area 11 as well as on its forward end area 10 with a corresponding bearing surface for the support with respect to the depression 2 of the body shell 1, which bearing surface rests, in the inoperative position of the gripping bow 4, in each case on an assigned supporting section of the body shell 1. In this case, a corresponding bearing surface on the rearward end area 11 is particularly decisive for the supporting of the gripping bow 4 because the gripping bow 4 is secured anyhow on its forward end area 10 by way of the swivel bearing relative to the body shell 1.

Figure 3:
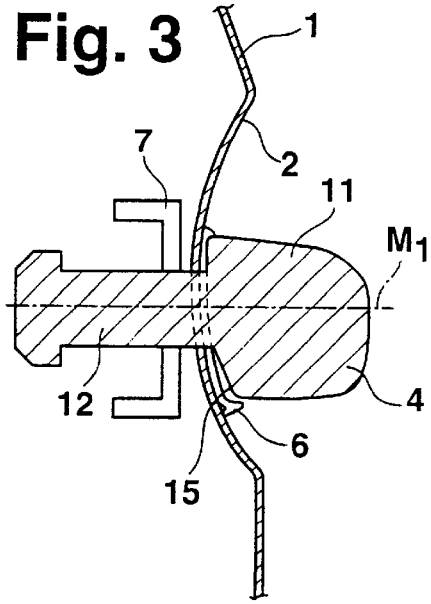
FIG. 3 is a sectional view of the grip arrangement according to FIG. 1 along the section Line III—III in FIG. 1 when the body shell is not deformed.

The supporting surface of the gripping bow 4 on the rearward end area 11 facing the body shell 1 and thus the depression 2, which rearward end area 11 can also be called the bearing surface, rests, as illustrated in FIG. 3, in the inoperative position of the gripping bow 4 only in the area of the upper half of the end area 11, on the exterior side of the depression 2, which forms a supporting section. Below a horizontal longitudinal center plane $M_1$ of the gripping bow 4, the surface of the end area 11 facing the depression is designed such that, in the inoperative position, a gap-type clearing 15 exists between the depression 2 and the gripping bow 4 at the level of the end area 11. The clearing 15 is formed in that the bearing surface of the end area 11 facing the depression 2 and thus the supporting section of the body shell 1 below the longitudinal center plane $M_1$ is not curved corresponding to a center radius of the depression 3 but offset at an angle thereto. As a result, a gap is formed which starts approximately at the level of the longitudinal center plane $M_1$ and expands continuously in the downward direction (FIG. 3). The dash-dotted line in FIG. 4, which has the reference number $M_2$, represents a parallel line to a central radius line of the clearing 15.

In order to prevent that the gap formed by the clearing 15 in the inoperative position of the gripping bow 4 is visible between the bearing surface of the gripping bow 4 and the depression 2, a surrounding flexible covering lip 6 is provided which forms the edge of a thin rubber disk ring which is not described in detail and which, around the passage for the activating web 12, rests on the exterior side of the depression 2 and forms the supporting section for the gripping bow 4 on the rearward end area 11. The covering lip 6 is molded in one piece to this ring disk and projects from the depression 2 toward the outside.

Figure 4:
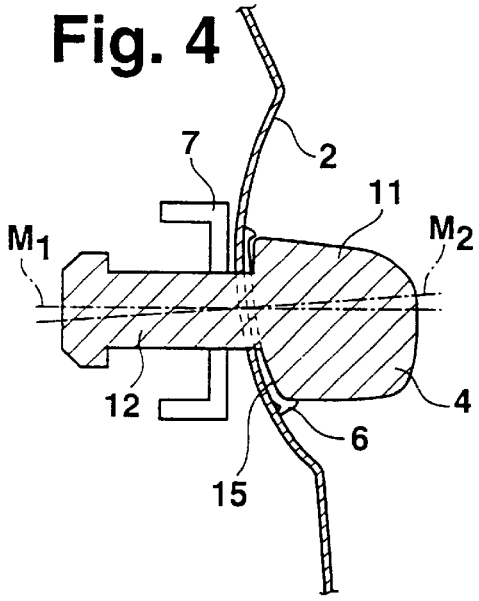
FIG. 4 is a sectional view according to FIG. 3, but shown with a deformed body shell.

As illustrated in FIG. 4, in the event of a deformation of the body shell 1 including the depression 2 as the result of a corresponding vehicle impact, no deformation forces are transmitted to the gripping bow 4, because, as the result of the clearing 15, the depression 2 can be deformed and displaced toward the gripping bow 4 without the transmission of corresponding forces to the gripping bow which would cause a pressing-toward-the-outside of the gripping bow 4. If the clearing 15 were not to exist, the depression 2 and thus the body shell 1 would exercise at a significantly earlier point in time, in the event of a beginning deformation, corresponding pressure forces on the gripping bow 4 in the transverse direction of the vehicle toward the outside, whereby the gripping bow 4, while possibly activating the lock triggering unit 13, would be pressed toward the outside. This clearing 15 therefore reliably prevents such a stressing of the gripping bow 4.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Handle grip assembly for a vehicle door, having a gripping bow which is arranged on a shell of the vehicle door and being movable by pulling, which gripping bow is in an operative connection with a lock triggering element of a door lock, the gripping bow being supported at a rearward end area by at least one bow bearing support surface in its inoperative position on a corresponding bearing supporting surface arranged inside a curved depression of the body shell, wherein the rearward end area of the gripping bow is provided with a surface adjacent to the at least one bow bearing support surface which forms a clearing which, in the inoperative position, is defined by a space formed between the surface of the gripping bow and a portion of the bearing supporting surface of the body shell facing the surface of the gripping bow, and wherein the clearing is surrounded in the inoperative position by a flexible covering lip.

2. Handle grip assembly according to claim 1, wherein the clearing has a curvature which is offset at an angle with respect to an arching of the depression.

3. Handle grip assembly according to claim 1, wherein the clearing is provided on a lower half of the gripping bow relative to an installed operating position thereof.

4. Handle grip assembly according to claim 2, wherein the clearing is provided on a lower half of the gripping bow relative to an installed operating position thereof.

5. A handle grip assembly for a vehicle door comprising:

a gripping bow arranged on a shell of the vehicle door and being movable by pulling, wherein the gripping bow is in an operative connection with a lock triggering element of a door lock and is supported by at least one bow bearing support surface in an inoperative position on a corresponding bearing supporting surface of the body shell;

wherein the gripping bow is provided with a surface adjacent to the at least one bow bearing support surface, the surface forming a clearing which, in the inoperative position, is defined by a space formed between the surface of the gripping bow and a portion of the bearing supporting surface of the body shell facing the surface of the gripping bow; and wherein the clearing is surrounded in the inoperative position by a flexible covering lip.

6. The handle grip assembly according to claim 5, wherein the bearing supporting surface of the body shell is arranged inside a curved depression of the body shell; and wherein the clearing has a curvature which is offset at an angle with respect to an arching of the depression.

7. The handle grip assembly according to claim 6, wherein the clearing is provided on a lower half of the gripping bow relative to an installed operating position thereof.

8. The handle grip assembly according to claim 5, wherein the clearing is provided on a lower half of the gripping bow relative to an installed operating position thereof.

9. A vehicle door and grip assembly comprising:

a vehicle door shell;

a manually engageable gripping bow supported at the door shell and movable between an operative position acting on a door lock assembly to unlatch the door and an inoperative normal closed position;

wherein said gripping bow and door shell are spaced from one another along facing respective bow gripping sections to form an opening for manually grasping the gripping bow to move the gripping bow from the inoperative to the operative position;

wherein said gripping bow is abuttingly supported along a bow bearing support surface with a counter bearing support surface of the door shell when in said inoperative position, said bearing support surfaces being spaced from the bow gripping section;

wherein facing surfaces comprising (i) a surface adjacent to the bow bearing support surface and (ii) a portion of the bearing support surface, and spaced from the bow gripping sections, are spaced from one another to form a clearance, said clearance being configured to limit body shell movement induced movement of the gripping bow to an operative position unlocking the door in an event of a vehicle collision deforming the body shell; and wherein a flexible covering lip is arranged to surround the clearance when the gripping bow is in the inoperative position.

10. A vehicle door and grip assembly comprising:

a vehicle door shell;

a manually engageable gripping bow supported at the door shell and movable between an operative position acting on a door lock assembly to unlatch the door and an inoperative normal closed position;

wherein said gripping bow and door shell are spaced from one another along facing respective bow gripping sections to form an opening for manually grasping the gripping bow to move the gripping bow from the inoperative to the operative position;

wherein said gripping bow is abuttingly supported along a bow bearing support surface with a counter bearing support surface of the door shell when in said inoperative position, said bearing support surfaces being spaced from the bow gripping section;

wherein facing surfaces comprising (i) a surface adjacent to the bow bearing support surface and (ii) a portion of the bearing support surface, and spaced from the bow gripping sections, are spaced from one another to form a clearance, said clearance being configured to limit body shell movement induced movement of the gripping bow to an operative position unlocking the door in an event of a vehicle collision deforming the body shell; and wherein said clearance is provided on a lower half of the gripping bow underneath the bow bearing support surface and a flexible covering lip is arranged to surround the clearance when the gripping bow is in the inoperative position.

11. A method of making a vehicle door and grip assembly comprising:

providing a vehicle door shell; and supporting a manually engageable gripping bow at the door shell to be movable between an operative position acting on a door lock assembly to unlatch a door and an inoperative normal closed position;

wherein said gripping bow and door shell are spaced from one another along facing respective bow gripping sections to form an opening for manually grasping the gripping bow to move the gripping bow from the inoperative to the operative position;

wherein said gripping bow is abuttingly supported along a bow bearing support surface with a counter bearing support surface of the door shell when in said inoperative position, said bearing support surfaces being spaced from the bow gripping section;

wherein facing surfaces comprising (i) a surface adjacent to the bow bearing support surface and (ii) a portion of the bearing support surface, and spaced from the bow gripping sections, are spaced from one another to form a clearance, said clearance being configured to limit body shell movement induced movement of the gripping bow to an operative position unlocking the door in an event of a vehicle collision deforming the body shell; and arranging a flexible covering lip to surround the clearance when the gripping bow is in the inoperative position.

* * * * *